US012055077B2

(12) United States Patent
Gruenbeck

(10) Patent No.: US 12,055,077 B2
(45) Date of Patent: Aug. 6, 2024

(54) METHOD AND DEVICE FOR INSPECTING THE FUNCTIONALITY OF A CRANKCASE VENTILATION SYSTEM OF AN INTERNAL COMBUSTION ENGINE

(71) Applicant: Vitesco Technologies GMBH, Hannover (DE)

(72) Inventor: Karl Gruenbeck, Kelheim (DE)

(73) Assignee: Vitesco Technologies GmbH

( * ) Notice: Subject to any disclaimer, the term of this patent is extended or adjusted under 35 U.S.C. 154(b) by 0 days.

(21) Appl. No.: 17/383,722

(22) Filed: Jul. 23, 2021

(65) Prior Publication Data

US 2021/0348529 A1 Nov. 11, 2021

Related U.S. Application Data

(63) Continuation of application No. PCT/EP2020/051555, filed on Jan. 23, 2020.

(30) Foreign Application Priority Data

Jan. 25, 2019 (DE) ..... 10 2019 200 982.4

(51) Int. Cl.
*F01M 13/00* (2006.01)
*F01M 1/20* (2006.01)
*F01M 13/02* (2006.01)

(52) U.S. Cl.
CPC ..... *F01M 1/20* (2013.01); *F01M 13/021* (2013.01); *F01M 2013/0083* (2013.01); *F01M 2250/60* (2013.01); *F01M 2250/62* (2013.01)

(58) Field of Classification Search
CPC ..... F01M 1/20; F01M 13/021; F01M 2013/0083; F01M 2013/0044; F01M 2013/026; F02D 2250/08
(Continued)

(56) References Cited

U.S. PATENT DOCUMENTS 9,790,885 B2 10/2017 Rollinger
10,982,574 B2 4/2021 Hofmann
2003/0106543 A1* 6/2003 Gschwindt ..... F01M 13/022 123/572
2011/0016957 A1 1/2011 Haladyna
2013/0228006 A1 9/2013 Kuhn
(Continued)

FOREIGN PATENT DOCUMENTS

CN 108952961 A * 12/2018 ..... F02B 77/10
DE 102010027117 A1 1/2011
(Continued)

OTHER PUBLICATIONS

International Search Report and Written Opinion dated Mar. 19, 2020 from corresponding International Patent Application No. PCT/EP2020/051555.
(Continued)

*Primary Examiner* — Logan M Kraft
*Assistant Examiner* — Joshua Campbell

(57) ABSTRACT

The disclosure relates to a method and a device for checking the functionality of a crankcase ventilation system of an internal combustion engine. The crankcase ventilation system includes two crankcase ventilation lines arranged between a crankcase outlet of a crankcase and an associated introduction point into an air path of the internal combustion engine, via which crankcase ventilation lines gas can be introduced from the crankcase into the air path. The method includes measuring a pressure in the crankcase, supplying the measured pressure values to a control unit, and calculating the gradient of the measured pressure. The method also includes performing a gradient check, checking whether the gradient satisfies a specified criterion, and returning to the measurement of the pressure if the gradient satisfies the specified criterion. The method also includes recording an entry in a fault memory if the gradient does not satisfy the specified criterion.

8 Claims, 9 Drawing Sheets

(58) Field of Classification Search
USPC ..... 123/196 S, 196 CP, 572–574
See application file for complete search history.

(56) References Cited

U.S. PATENT DOCUMENTS

| | | | | |
|---|---|---|---|---|
| 2014/0081564 | A1* | 3/2014 | Pursifull | G01M 15/08 701/101 |
| 2016/0195449 | A1 | 7/2016 | Haselbeck | |
| 2016/0230624 | A1 | 8/2016 | Rollinger | |
| 2017/0268448 | A1* | 9/2017 | Takahashi | F02M 25/06 |
| 2018/0371971 | A1* | 12/2018 | Nakano | F02M 35/10222 |

FOREIGN PATENT DOCUMENTS

| | | | | |
|---|---|---|---|---|
| DE | 102013218264 | A1 | 3/2014 | |
| DE | 102013218265 | A1 | 5/2014 | |
| DE | 102013218296 | A1 | 5/2014 | |
| DE | 102013225388 | A1 | 6/2015 | |
| DE | 102016209450 | A1 | 5/2016 | |
| DE | 102016216122 | A1 | 3/2018 | |
| DE | 102017108246 | A1 | 10/2018 | |
| DE | 102017108246 | A1 * | 10/2018 | F02D 41/22 |
| EP | 2616655 | A1 | 7/2013 | |
| KR | 0174097 | B1 * | 5/1997 | F01M 13/00 |

OTHER PUBLICATIONS

German Office Action dated Oct. 9, 2019 for corresponding German Patent Application No. 10 2019 200 982.4.

Chinese Office Action dated Aug. 22, 2003 for corresponding Chinese Patent Application No. 202080010647.6.

* cited by examiner

METHOD AND DEVICE FOR INSPECTING THE FUNCTIONALITY OF A CRANKCASE VENTILATION SYSTEM OF AN INTERNAL COMBUSTION ENGINE

CROSS-REFERENCE TO RELATED APPLICATIONS

This application claims the benefit of International Application PCT/EP2020/051555, filed Jan. 23, 2020, which claims priority to German Application 10 2019 200 982.4, filed Jan. 25, 2019. The disclosures of the above applications are incorporated herein by reference.

TECHNICAL FIELD

The disclosure relates to a method and a device for checking the functionality of a crankcase ventilation system of an internal combustion engine.

BACKGROUND

A crankcase ventilation system of an internal combustion engine is provided for feeding the gases that flow out of the combustion chamber of the internal combustion engine past the piston rings, usually referred to as blowby, to the intake tract of the internal combustion engine in order to avoid a pressure increase above ambient pressure. An inadmissible overpressure can lead to increased emissions and to engine damage. In the case of supercharged engines, it is generally the case that two ventilation lines are provided which introduce the crankcase gases on the one hand, in naturally aspirated operation, into the intake tract downstream of a throttle flap provided in the intake tract and on the other hand, in supercharged operation, into the intake tract downstream of an air filter box upstream of the supercharging blower (compressor).

According to provided statutory regulations, monitoring of all lines that conduct gases out of the crankcase is necessary. It is the intention here to ensure that no unpurified exhaust gases and no unburned fuel-air mixture can escape into the environment. For this reason, identification of a leak of the order of magnitude of the smallest line cross section in the crankcase ventilation system is prescribed.

Whereas the line for throttled operation can already be monitored by various diagnostic functions of the air path and/or mixture control, or monitoring is not prescribed because the ventilation channels run within the engine block, the situation for the line that is relevant in supercharged operation, in which the intake pipe pressure is higher than the ambient pressure, poses significantly greater difficulties. An identification of leaks, also due to aging effects, is imperatively necessary because of the legal situation.

DE 10 2010 027 117 A1 has disclosed a method and a system for monitoring a proper connection between a valve/separator and an inlet system through a crankcase ventilation system. In this known system, an electrical circuit detects electrical continuity through a hose connector and the one out of valve/separator connector or the inlet system connector that is mechanically connectable to the hose connector. Using a wire integrated in the hose connector, electrical short circuits and thus an interrupted connection can be detected.

A method and a device for diagnosing a crankcase ventilation arrangement of internal combustion engines are known from EP 2 616 655 B1. The crankcase is connected to an air feed system of the internal combustion engine via the ventilation device. In the case of this known method, a pressure difference between an ambient pressure and a crankcase pressure is ascertained and the presence of a fault in the ventilation device is determined in a manner dependent on the ascertained pressure difference if an enablement condition is satisfied. The enablement condition is satisfied if an air mass flow, filtered by a low-pass filter, in the air feed system exceeds, in terms of magnitude, a specified first threshold value.

A method for identifying a leak in a crankcase ventilation arrangement of an internal combustion engine is known from DE 10 2013 225 388 A1. Here, a cavity of a crankcase is connected in gas-conducting fashion to a fresh-air tract of the internal combustion engine. Furthermore, a pressure sensor is provided for measuring a pressure in the cavity, where an electronic control unit is provided for evaluating the signals thereof. A measurement of a gas pressure is performed by the pressure sensor in the crankcase ventilation system in the presence of a defined rotational speed and load of the internal combustion engine. Furthermore, a comparison of an actual pressure value with a setpoint pressure value is performed. If the actual pressure value exceeds the setpoint pressure value, the presence of a leak is identified.

SUMMARY

A method and a device for checking the functionality of a crankcase ventilation system of an internal combustion engine is provided, where the check results obtained are highly reliable. The crankcase ventilation system has two crankcase ventilation lines which are arranged between a crankcase outlet of a crankcase and a respectively associated introduction point into an air path of the internal combustion engine, via which crankcase ventilation lines gas can be introduced from the crankcase into the air path. The method includes measuring a pressure in the crankcase by way of a crankcase pressure sensor, supplying the measured pressure values to a control unit, calculating the gradient with respect to time of the measured pressure, performing a gradient check, checking whether the gradient satisfies a specified criterion, returning to the measurement of the pressure if the gradient satisfies the specified criterion, recording an entry in a fault memory if the gradient does not satisfy the specified criterion.

By way of an evaluation of a pressure measured by a crankcase pressure sensor, reliable statements can be made as to whether and which component within the crankcase ventilation system is faulty.

Implementations of the disclosure may include one or more of the following optional features. In some implementations, the measurement of the pressure in the crankcase is performed by a pressure sensor which is arranged in the crankcase or in a line which is directly connected to the crankcase.

In some examples, a detection of a change in the operating point of the internal combustion engine is performed, and the gradient check is performed taking into consideration a detected change in the operating point.

In some implementations, it is detected whether a starting or stopping of the internal combustion engine has been performed, and the gradient check is performed in reaction to the detected starting or stopping of the internal combustion engine.

In some examples, in the case of starting or stopping of the internal combustion engine being detected, admissible limit values for the gradient are ascertained and used for the gradient check.

In some implementations, it is detected whether a negative or a positive load change of the internal combustion engine has been performed, and the gradient check is performed in reaction to the detected load change.

In some examples, in the case of a load change being detected, a threshold value for the gradient is ascertained and used for the gradient check.

In some implementations, a calculation of a model pressure is performed, and the gradient check is performed taking into consideration the ascertained model pressure. In the case of such a model being used, it is possible here to change over from a discontinuous to a continuous gradient check.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
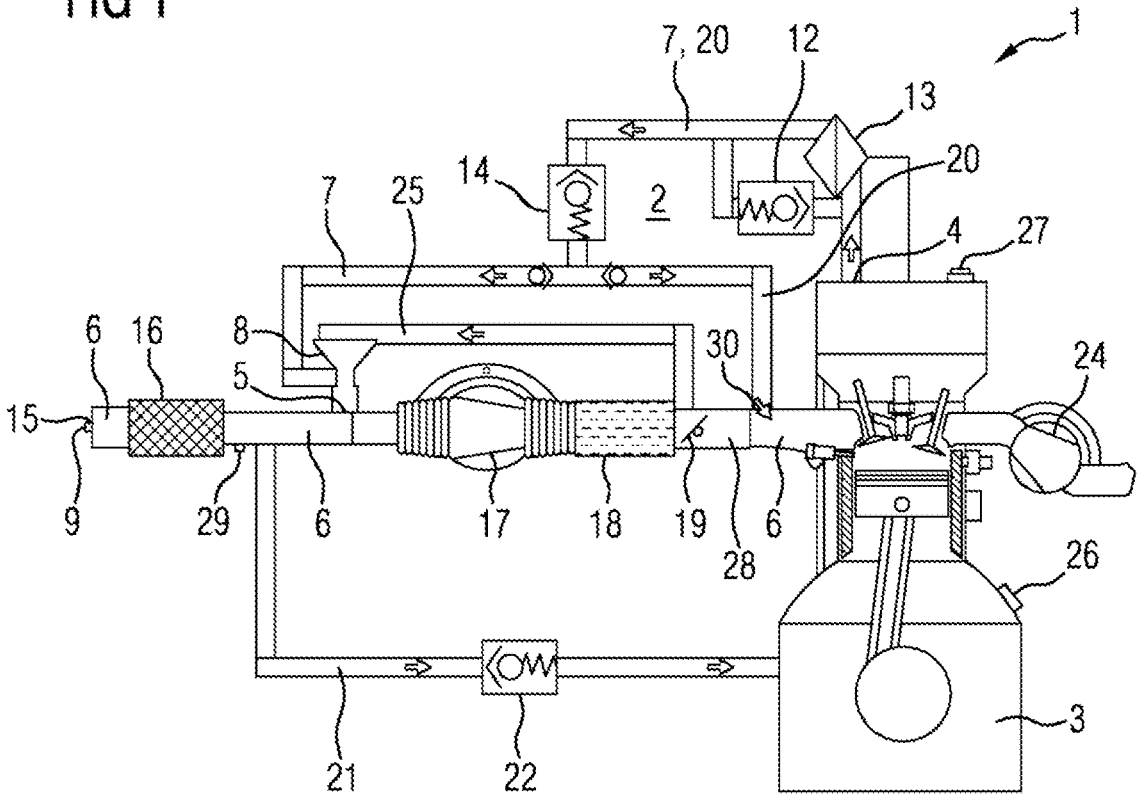
FIG. 1 shows a schematic sketch for illustrating a device for checking the functionality of a crankcase ventilation system of an internal combustion engine.
Figure 1:
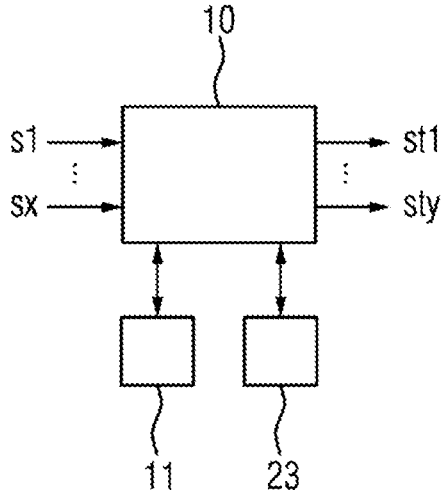

FIG. 1 shows a schematic sketch for illustrating a device for checking the functionality of a crankcase ventilation system 2 of an internal combustion engine 1.

The illustrated internal combustion engine 1 includes a crankcase 3 from which gases are discharged via a crankcase outlet 4. Gases are introduced via crankcase ventilation lines 7 and 20 into an air path 6 of the internal combustion engine 1 at introduction points 5 and 30 respectively. As shown, an oil separator 13 and a pressure control valve 14 are arranged in these crankcase ventilation lines 7, 20 between the crankcase outlet 4 and the introduction points 5 and 30 respectively. Downstream of the pressure control valve 14, the crankcase ventilation line 7 separates from the crankcase ventilation line 20. The crankcase ventilation line 7 opens into the air path 6 via a suction jet pump 8 at the introduction point 5 upstream of a compressor 17. The motive mass flow is provided here from the high-pressure side of the compressor 17 and fed to the suction jet pump 8 via a motive jet line 25. The crankcase ventilation line 20 opens into the air path 6 downstream of a throttle flap 19 at the introduction point 30.

In naturally aspirated operation of the internal combustion engine 1, the throttle flap 19 is closed and the gas pressure within the air path 6 downstream of the throttle flap 19 is lower than the ambient air pressure. Consequently, gas discharged from the crankcase 3 is introduced via the oil separator 13, the pressure control valve 14 and the crankcase ventilation line 20 into the air path 6 downstream of the throttle flap 19.

In supercharged operation of the internal combustion engine 1, the throttle flap 19 is opened, such that fresh air fed to the air path 6 via a fresh-air inlet 15 is fed via an air filter 16, the compressor 17, a charge-air cooler 18 and the opened throttle flap 19 to the combustion chamber, arranged within the crankcase 3, of the internal combustion engine 1. In this supercharged operation of the internal combustion engine 1, the air pressure in the air path 6 in the region downstream of the throttle flap 19 is higher than the ambient air pressure. Consequently, gas discharged from the crankcase 3 is introduced via the oil separator 13 and the pressure control valve 14 into the air path 6 not downstream of the throttle flap 19 but at the introduction point 5. This introduction point 5 is positioned in the air path 6 downstream of the air filter 16 but upstream of the compressor 17, the charge-air cooler 18 and the throttle flap 19.

The device illustrated in FIG. 1 furthermore has a crankcase pressure sensor 26 which is arranged in the crankcase 3 and by way of which the pressure prevailing in the crankcase 3 is measured. Furthermore, an ambient pressure sensor 9 is arranged in the region of the fresh-air inlet 15 of the air path 6, a first intake pipe pressure sensor 29, which is not imperatively necessary for the method presented, is arranged between the air filter 16 and the compressor 17, and a second intake pipe pressure sensor 28 is arranged between the throttle flap 19 and the crankcase 3.

The output signals provided by the pressure sensors 26, 9, 29 and 28 are supplied as sensor signals s1, s2, s3 and s4 to a control unit 10 and evaluated therein in order to perform a check of the functionality of the crankcase ventilation system 2 of the internal combustion engine 1, as will be discussed in more detail below.

It can also be seen from FIG. 1 that the illustrated device has a fresh-air line 21 which branches off from the air path 6 and which is connected via a check valve 22 to a fresh-air inlet of the crankcase 3. This fresh air is used to improve the air flow through the crankcase 3.

Also illustrated in FIG. 1 is a turbine 24 which, together with the compressor 17, is a constituent part of an exhaust-gas turbocharger of the internal combustion engine 1. Hot exhaust gas from the internal combustion engine is fed to the turbine 24 and sets the turbine wheel of the turbine in rotation. The turbine wheel is connected via a shaft of the exhaust-gas turbocharger to a compressor wheel, which is likewise fixedly connected to the shaft, of the compressor 17, such that the compressor wheel is also set in rotational motion and the fresh air fed to the compressor 17 is compressed. This compressed fresh air is fed to the combustion chambers of the internal combustion engine 1 in order to increase the performance thereof.

The oil separator 13 is provided for separating off oil that is contained in the gases discharged via the crankcase outlet 4, and for returning the oil to the crankcase 3.

Furthermore, as shown in FIG. 1, an additional channel bypassing the oil separator 13 via a safety valve 12 is provided between the crankcase outlet 4 and the pressure control valve 14. In the event of a blockage of the oil separator 13, the gas discharged via the crankcase outlet 4 is conducted via this additional channel into the crankcase ventilation line 7 downstream of the oil separator.

Furthermore, the device illustrated in FIG. 1 has an oil cap 27 that closes off the crankcase 3.

It is furthermore illustrated in FIG. 1 that the control unit 10 interacts with memories 11 and 23. The memory 11 is a memory in which the working programs of the control unit are stored. The memory 23 is a data memory in which data are stored which the control unit 10 requires inter alia for checking the functionality of the crankcase ventilation system. These data include for example specified, empirically ascertained data, data stored in one or more characteristic maps, or data corresponding to a pressure model. The control unit 10 evaluates sensor signals s1-sx supplied to it, which sensor signals include the sensor signals S1, S2, S3, S4 provided by the pressure sensors, using data stored in the memory 23 in order to provide control signals stl-sty for various components of the internal combustion engine and inter alia to check the functionality of the crankcase ventilation system 2 of the internal combustion engine 1 and to identify whether or not the crankcase ventilation system is functional.

The device illustrated in FIG. 1 accordingly shows a crankcase ventilation system of a supercharged internal combustion engine, in the case of which two crankcase ventilation lines lead from the crankcase outlet into the air path of the internal combustion engine, which crankcase ventilation lines conduct gases from the crankcase into the air path. Here, the crankcase ventilation line 20 is connected to the air path 6 downstream of a throttle flap 27 which controls the air mass flow, and the crankcase ventilation line is active during throttled operation, in which the pressure prevailing between the throttle flap 19 and the inlet of the crankcase 3 is lower than the ambient pressure. By contrast, the crankcase ventilation line 7 is active, and conducts gas discharged from the crankcase 3 back into the air path 6 of the internal combustion engine via the introduction point 5, in supercharged operation of the internal combustion engine, in which the pressure prevailing between the throttle flap 19 and the inlet of the crankcase 3 is higher than the ambient pressure. In order to ensure that effective ventilation of the crankcase can take place even during supercharged operation of the internal combustion engine, the suction jet pump 8 described above, to which the crankcase ventilation line 7 is connected, is used. For an intact crankcase ventilation system, the use of this suction jet pump 8 results in a significant negative pressure in the crankcase in relation to the ambient pressure, even in supercharged operation. This makes the identification of a malfunction considerably easier.

If use is not made of a suction jet pump, then the ventilation of the crankcase can however also be promoted through evaluation of the slight negative pressure that prevails downstream of the air filter 16.

Below, with reference to the further figures, examples of the disclosure will be explained in the case of which, for various dynamic changes in the operating point, qualitative pressure profiles for the pressure prevailing in the crankcase and the pressure prevailing in the air path between the throttle flap 19 and the inlet of the crankcase are illustrated in each case for an intact system (OK) and a faulty system. In all of these cases, the gradient of the pressure prevailing in the crankcase 3 is used as a diagnostic criterion.

Figure 2:
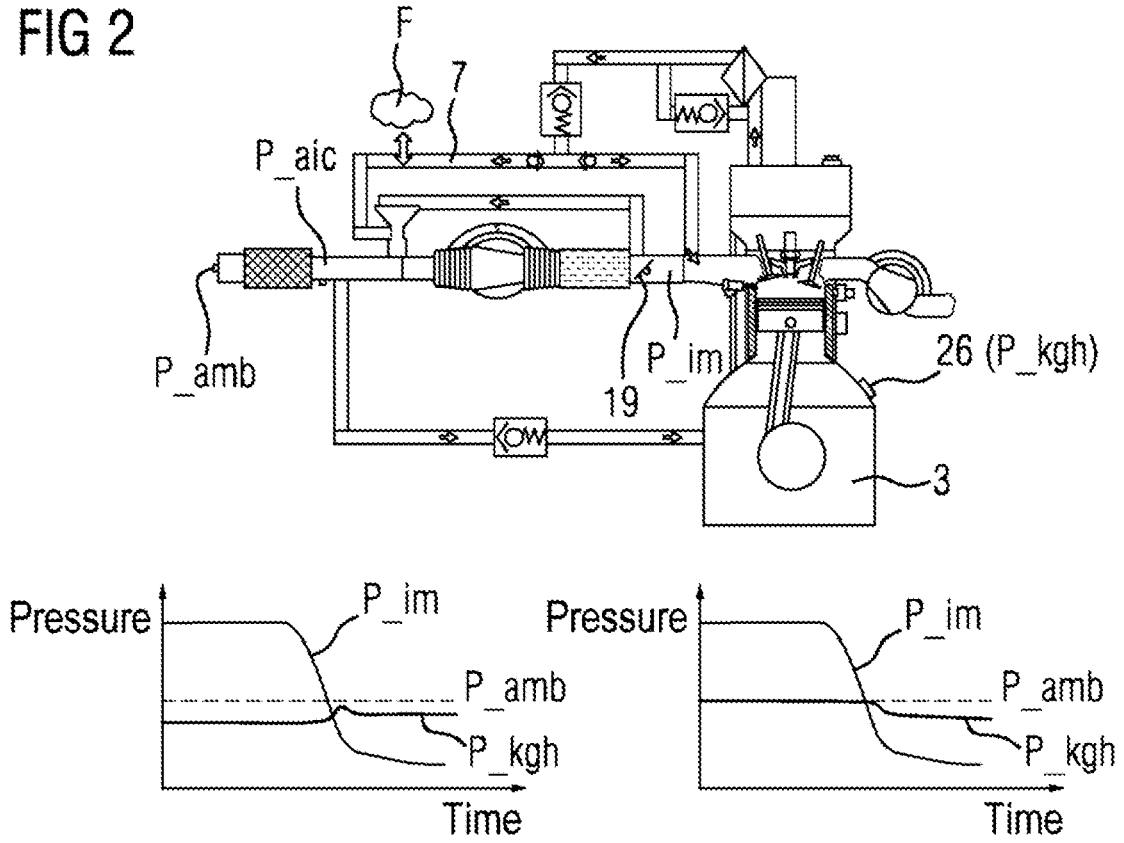
FIG. 2 shows sketches for explaining a first example of the disclosure.

FIG. 2 shows sketches for explaining a first example of the disclosure. In this example, a leak has occurred at the point denoted by the letter "F" in the crankcase ventilation line 7.

A leak in the ventilation line 7 leads to an impairment of the crankcase ventilation, because the pressure in the crankcase ventilation line is significantly higher in this case than in the intact state of the crankcase ventilation system. Consequently, the pressure P_kgh measured by the crankcase pressure sensor 26 during supercharged operation, in which the pressure P_im prevailing between the throttle flap 19 and the inlet of the crankcase 3 is higher than the ambient pressure P_amb, is also higher and, depending on the magnitude of the leak, may also be almost ambient pressure, as illustrated in the lower right-hand diagram of FIG. 2.

If the driver of the vehicle powered by the internal combustion engine actuates the accelerator pedal to a lesser degree or takes their foot off the accelerator pedal entirely, then the intake pipe pressure P_im is abruptly reduced and the internal combustion engine switches to throttled operation, in which the following relationship applies:

$$P_im < P_amb$$

During this negative load change, a change from crankcase ventilation line 7 to crankcase ventilation line 20 also occurs. If the crankcase ventilation line 20 is intact, then the regular crankcase pressure is set again by the pressure control valve 14. However, since, in the event of a fault, ventilation is performed from a considerably higher pressure P_kgh in the air path 6 or the intake pipe, the pressure gradient of P_kgh has large negative values. From this, it can be inferred that the crankcase ventilation line 7 is defective, because otherwise effective ventilation would have to have taken place during supercharged operation.

A leak or blockage within the motive jet line 25 results in a loss of crankcase ventilation performance 7. Therefore, for such a fault, the same statements as those for a defective crankcase ventilation line 7 are applicable.

Figure 3:
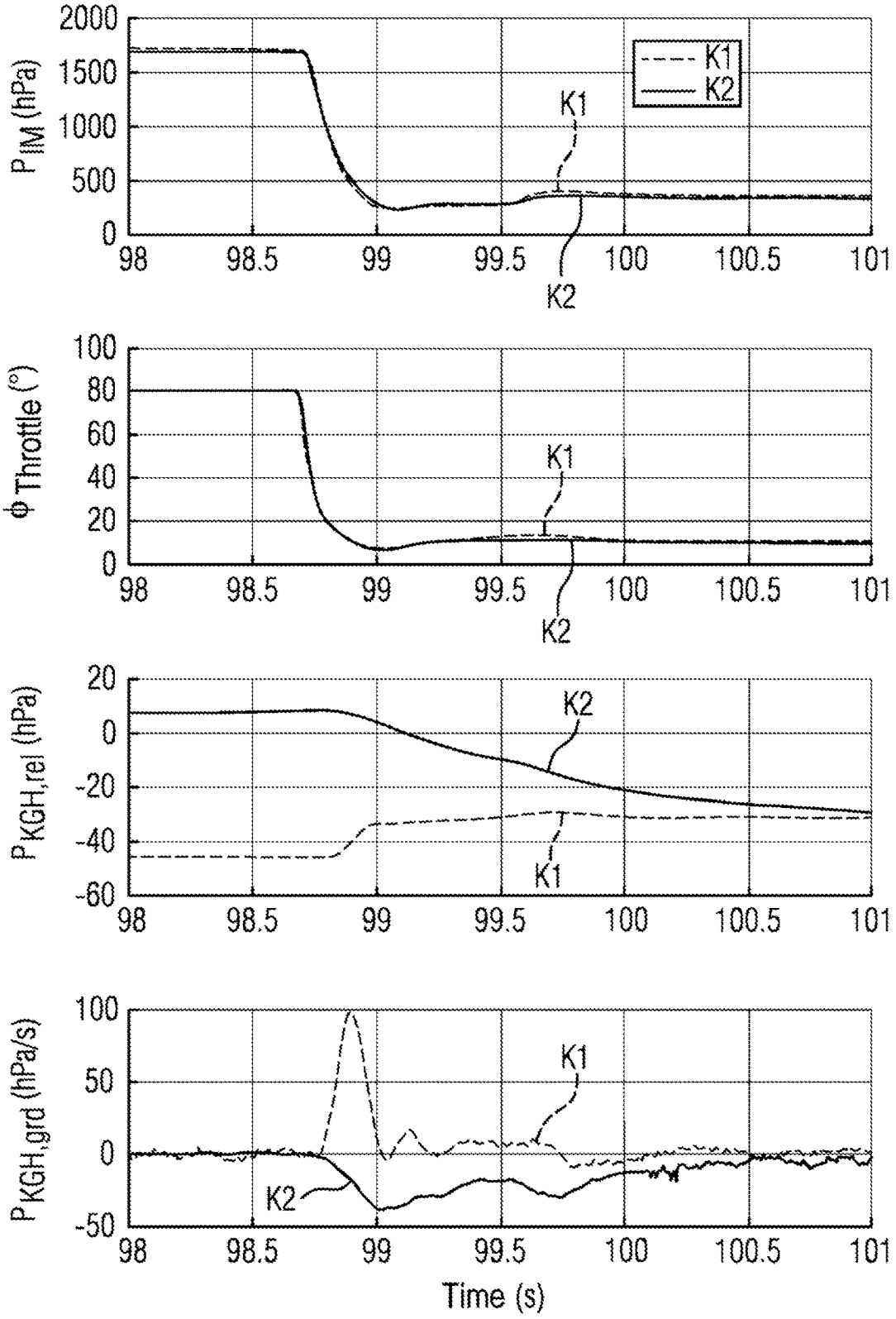
FIG. 3 shows diagrams for illustrating measurement results.

As a proof of concept for leak identification in the crankcase ventilation line 7, FIG. 3 shows diagrams for illustrating measurement results. The curves denoted by K1 and shown with dashed lines each represent an intact crankcase ventilation system, and the curves denoted by K2 each represent a faulty crankcase ventilation system. Here, the fault situation was simulated by unplugging the crankcase ventilation line 7. Here, the measured value P_kgh_rel represents the relative pressure in relation to the ambient pressure. The respective gradients P_kgh_grd show the behavior described above with reference to FIG. 2. On the basis of a simple comparison of the gradient with a threshold value, the leak present in the crankcase ventilation line 7 can be identified and a corresponding entry can be recorded in a fault memory of the control unit 10.

Figure 4:
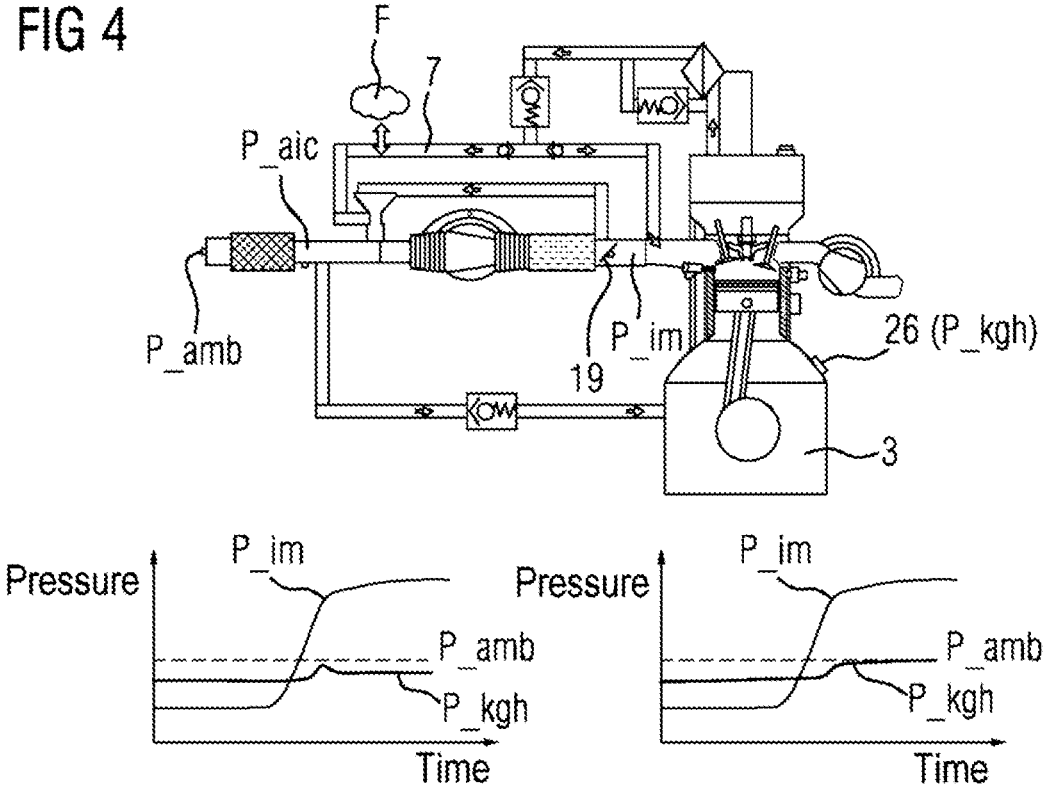
FIG. 4 shows sketches for explaining a second example of the disclosure.

FIG. 4 shows sketches for explaining a second example of the disclosure. In this example, a leak has again occurred at the point denoted by the letter "F" in the crankcase ventilation line 7.

In the event of a leak in the crankcase ventilation line 7, the crankcase pressure P_kgh behaves in a correspondingly reversed manner in the presence of a positive load change. Consequently, the pressure gradient is positive over a longer period of time in the case of a positive load change than in the presence of an intact crankcase ventilation system. This is evident from a comparison of the two lower diagrams of FIG. 4, where the lower left-hand diagram shows the profile of the crankcase pressure P_kgh over time in the presence of an intact crankcase ventilation system, and the lower right-hand diagram shows the profile of the crankcase pressure P_kgh in the presence of a leak in the crankcase ventilation line 7.

A leak or blockage within the motive jet line 25 results in a loss of crankcase ventilation performance 7. Therefore, for such a fault, too, the same statements as those for a defective crankcase ventilation line 7 are applicable.

Figure 5:
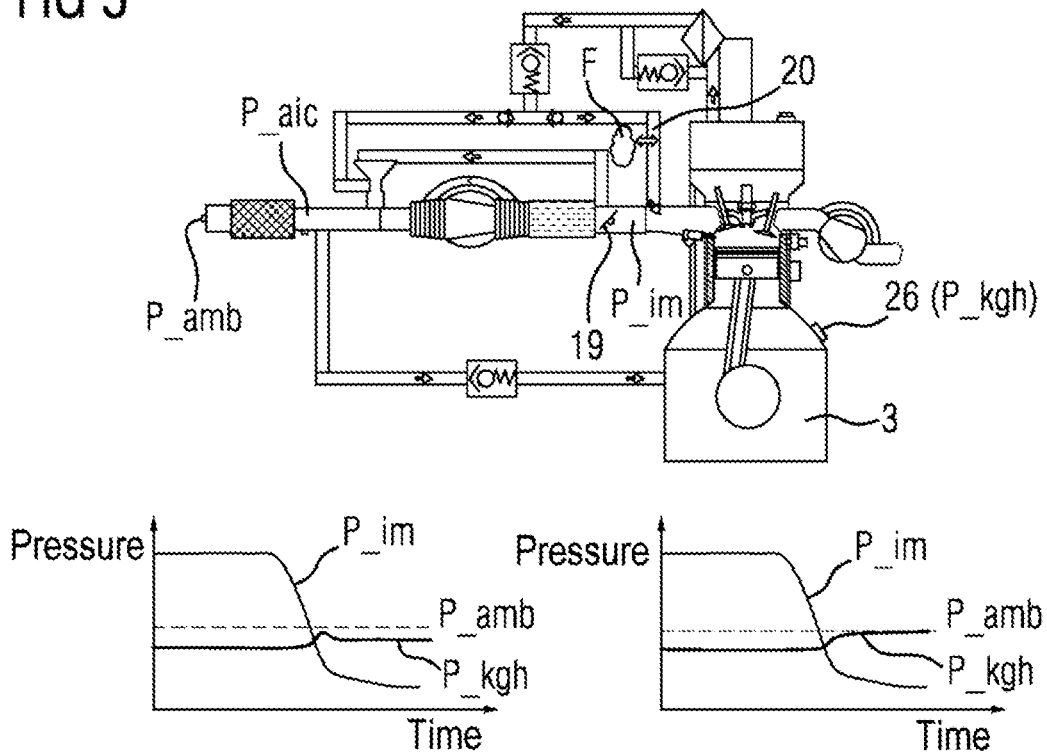
FIG. 5 shows sketches for explaining a third example of the disclosure.

FIG. 5 shows sketches for explaining a third example of the disclosure. In this example, a leak has occurred at the point denoted by the letter "F", where, by contrast to the examples shown in FIGS. 2 and 4, this point lies in the crankcase ventilation line 20.

If the crankcase ventilation line 20 has a leak, this may be detected through an evaluation of the gradient of the crankcase pressure P_kgh during a negative load change. In this case, the crankcase pressure rises over a longer period of time to approximately ambient pressure. This is evident from a comparison of the two lower diagrams of FIG. 5, where the lower left-hand diagram shows the profile of the crankcase pressure P_kgh over time in the presence of an intact crankcase ventilation system, and the lower right-hand diagram shows the profile of the crankcase pressure P_kgh in the presence of a leak in the crankcase ventilation line 20.

Figure 6:
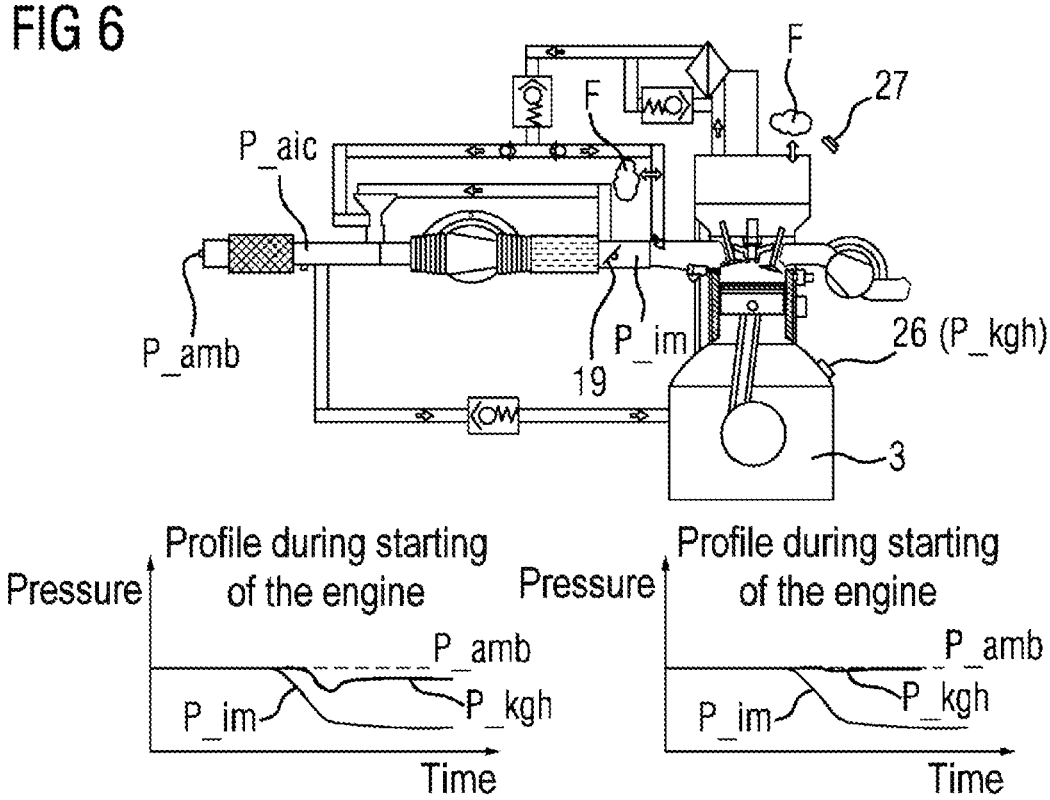
FIG. 6 shows sketches for explaining a fourth example of the disclosure.

FIG. 6 shows sketches for explaining a fourth example of the disclosure. If the gradient of the crankcase pressure P_kgh has excessively low negative values during starting-up of the engine, this indicates either that a leak is present in the ventilation line 20 or that the oil cap 27 is not closed. These two error cases are illustrated in the upper illustration of FIG. 6 by the letter "F" and can also be seen from the two lower diagrams of FIG. 6. The lower left-hand diagram of FIG. 6 shows the profile of the crankcase pressure P_kgh in the case of an intact system, and the lower right-hand diagram of FIG. 6 shows the profile of the crankcase pressure P_kgh in the presence of a leak in the crankcase ventilation line 20 or in the absence of an oil cap 27.

A quantitative evaluation of the gradient of the crankcase pressure P_kgh allows conclusions to be drawn regarding the magnitude of the leak and the actual location of the fault.

In the case of an internal combustion engine with start/stop function, starting-up of the engine occurs frequently, such that frequent checking of the crankcase ventilation line 20 can also be ensured. Consequently, it can also be checked just as frequently whether or not the oil cap 27 is sealingly closing the crankcase 3.

Figure 7:
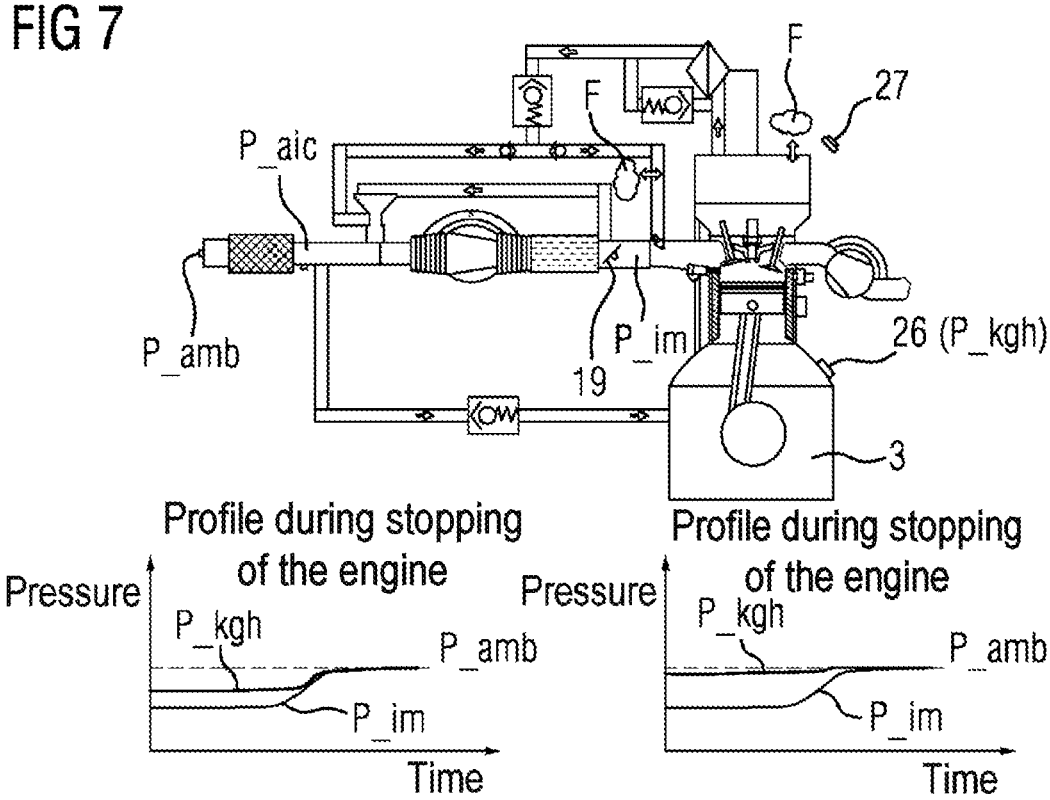
FIG. 7 shows sketches for explaining a fifth example of the disclosure.

FIG. 7 shows sketches for explaining a fifth example of the disclosure. If the gradient of the crankcase pressure P_kgh has excessively low positive values during stopping of the engine, this indicates either that a leak is present in the ventilation line 20 or that the oil cap 27 is not sealingly closed. These two error cases are illustrated in the upper illustration of FIG. 7 by the letter "F" and can also be seen from the two lower diagrams of FIG. 7. The lower left-hand diagram of FIG. 7 shows the profile of the crankcase pressure P_kgh in the case of an intact system, and the lower right-hand diagram of FIG. 7 shows the profile of the crankcase pressure P_kgh in the presence of a leak in the crankcase ventilation line 20 or in the absence of an oil cap 27.

A quantitative evaluation of the gradient of the crankcase pressure P_kgh allows conclusions to be drawn regarding the magnitude of the leak and the actual location of the fault.

In the case of an internal combustion engine with start/stop function, stopping of the engine occurs frequently, such that frequent checking of the crankcase ventilation line 20 can also be ensured. Consequently, it can also be checked just as frequently whether or not the oil cap 27 is closed.

Figure 8:
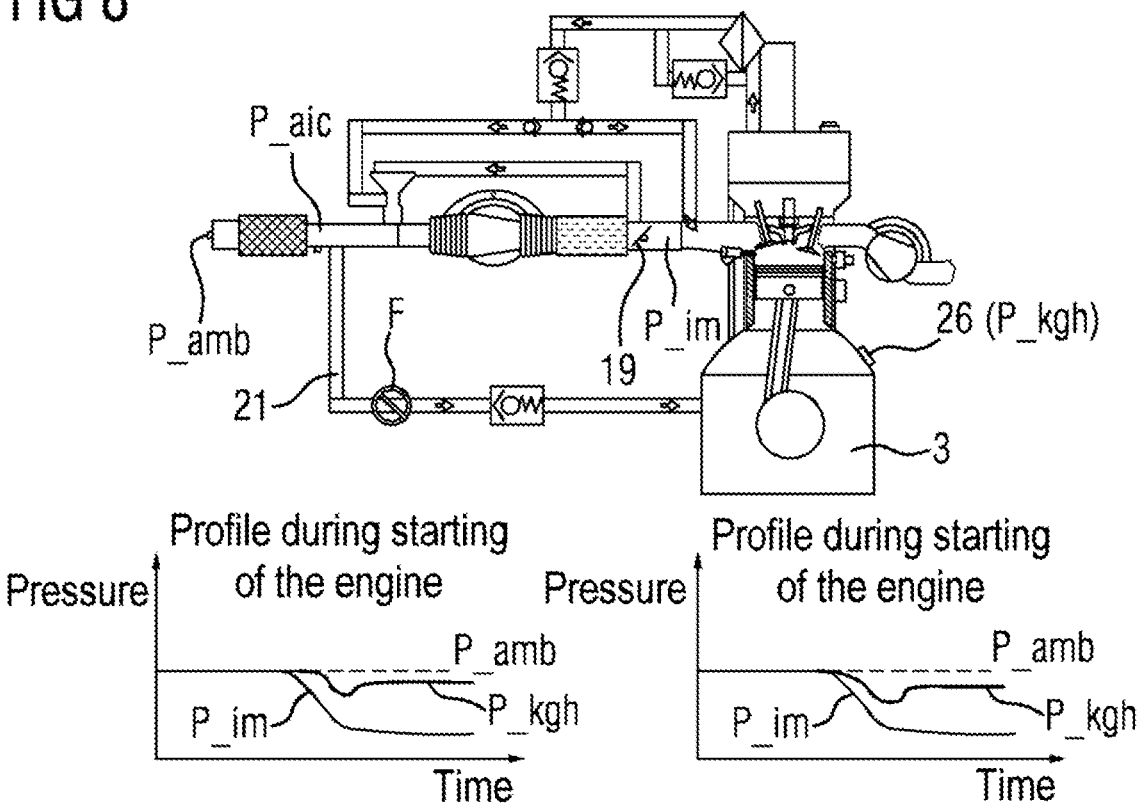
FIG. 8 shows sketches for explaining a sixth example of the disclosure.

FIG. 8 shows sketches for explaining a sixth example of the disclosure. In this case, a blocked ventilation line 21 is present, as indicated in the upper illustration of FIG. by the letter "F". In this case, the gradient of the crankcase pressure P_kgh during starting of the engine is considered. The crankcase volume is evacuated in a shorter time if the ventilation line 21 is blocked than in the presence of an intact ventilation line 21, because in this case no replenishing flow or only a lesser replenishing flow of fresh air is possible. This leads to a higher negative gradient of the crankcase pressure P_kgh during the starting-up of the engine over a long period of time. This is evident from a comparison of the two lower diagrams of FIG. 8. The profile of the crankcase pressure P_kgh in the case of an intact system is illustrated in the lower left-hand diagram of FIG. 8. The profile of the gradient of the crankcase pressure P_kgh in the presence of a blocked ventilation line 21 is illustrated in the lower right-hand diagram of FIG. 8.

Figure 9:
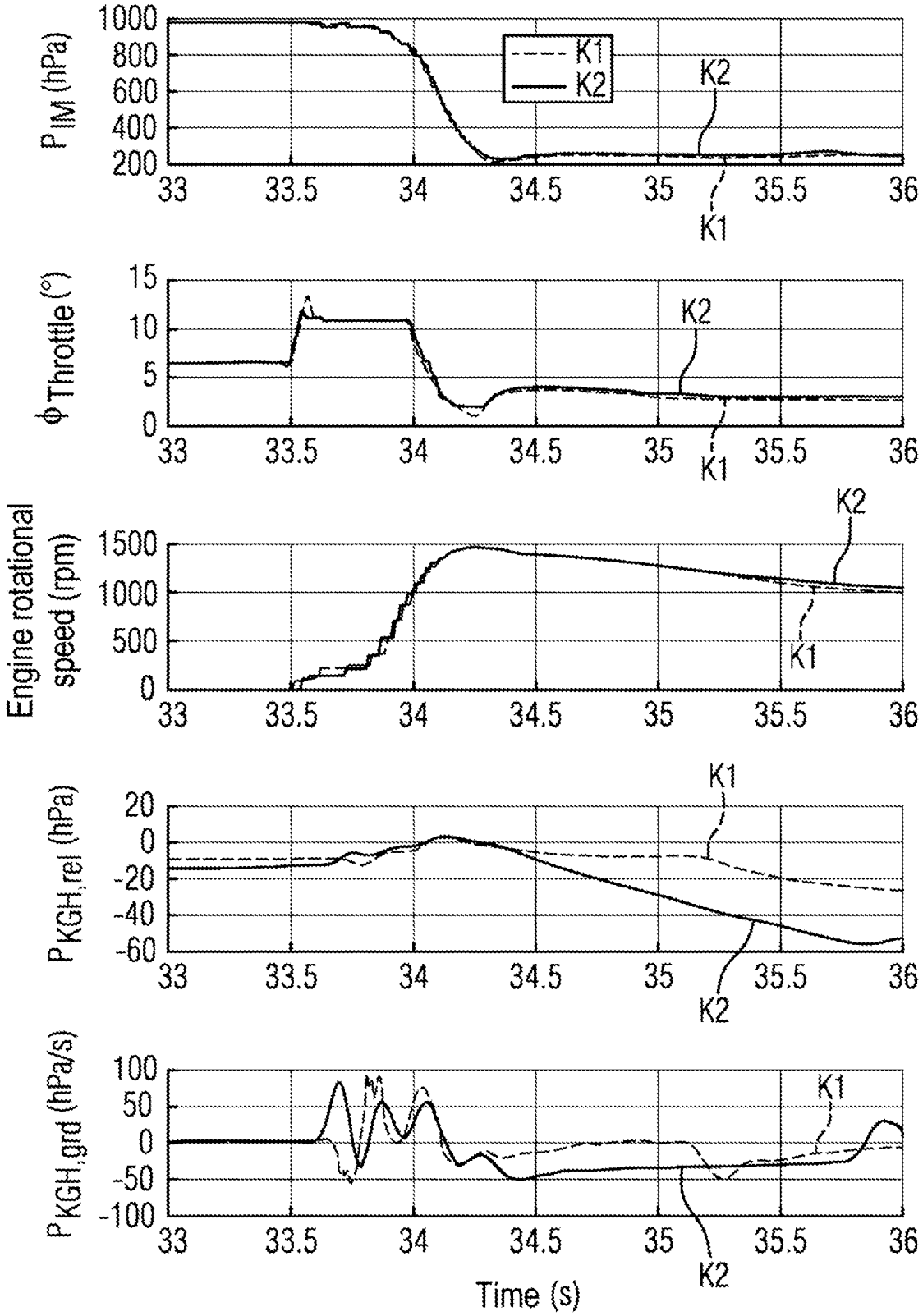
FIG. 9 shows diagrams for illustrating measurement results.

FIG. 9 shows diagrams for illustrating measurement results that were obtained on a real vehicle in which the above-described fault was present. In this figure, the curves denoted by K1 and shown with dashed lines each represent an intact ventilation line 21, and the curves denoted by K2 each represent a faulty ventilation line 21.

Figure 10:
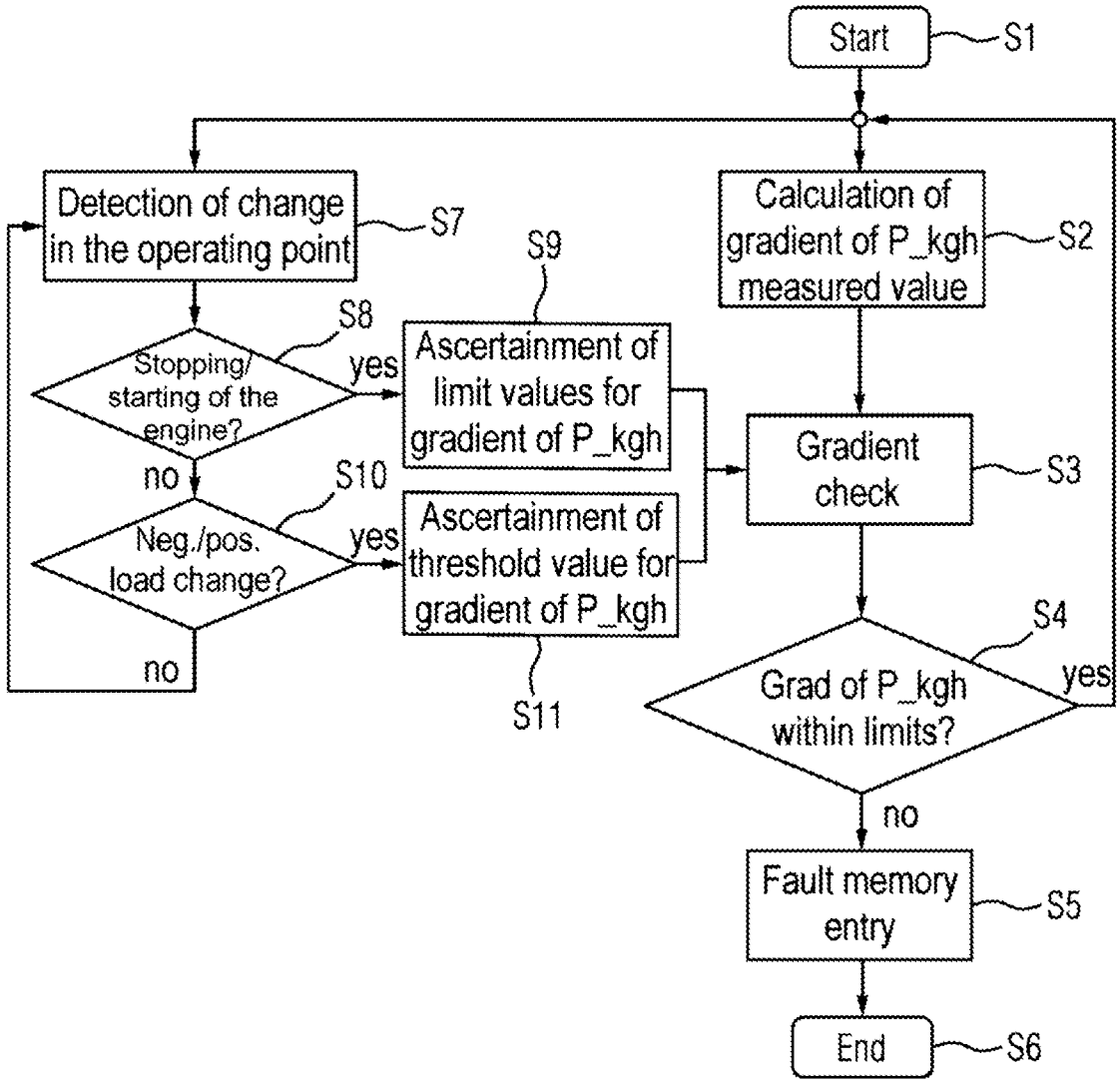
FIG. 10 shows a flow diagram for a first exemplary method for checking the functionality of a crankcase ventilation system of an internal combustion engine.

FIG. 10 shows a flow diagram for explaining a method for checking the functionality of a crankcase ventilation system of an internal combustion engine according to a first example for the disclosure.

This method begins with a step S1. This is followed, in a step S2, by a measurement of the crankcase pressure P_kgh by the crankcase pressure sensor 26, a transmission of the measured pressure value to the control unit 10, and a calculation of the gradient of the crankcase pressure by the control unit 10. In a subsequent step S3, a gradient check is performed in the control unit 10.

For the purposes of this gradient check, a detection of a change in the operating point is performed in a step S7. In a subsequent step S8, it is checked whether starting of the engine or stopping of the engine has been performed. If starting of the engine or stopping of the engine is identified, then a transition is made to a step S9, in which limit values for the gradient of the crankcase pressure P_kgh are ascertained. These limit values are used in step S3 for the abovementioned gradient check.

In a subsequent step S4, it is queried whether or not the ascertained gradient lies within the ascertained limit values. If the ascertained gradient lies within these limit values, then a return to step S2 is performed. If the ascertained gradient does not lie within the ascertained limit values, then a transition is made to step S5. In this step S5, an entry is recorded in a fault memory. Subsequently, a transition is made to a step S6, with which the method is ended.

If, by contrast, the query in step S8 yields that neither starting of the engine nor stopping of the engine is present, then a transition is made to a step S10. In this step S10, a check is performed as to whether a positive or a negative step change in load is present.

If this is not the case, then a return to step S7 is performed. If, by contrast, it is identified in step S10 that a positive or a negative step change in load is present, then a transition is made to a step S11. In this step S11, an ascertainment of a threshold value for the gradient of the crankcase pressure P_kgh measured by the crankcase sensor 26 is performed. This threshold value is used in step S3 for the abovementioned gradient check.

In a subsequent step S4, it is queried whether or not the ascertained gradient exceeds the ascertained threshold value. If the ascertained gradient does not exceed the abovementioned threshold value, then a return to step S2 is performed. If, by contrast, the ascertained gradient exceeds the abovementioned threshold value, then a transition is made to step S5. In this step S5, an entry is recorded in a fault memory. Subsequently, a transition is made to a step S6, with which the method is ended.

Figure 11:
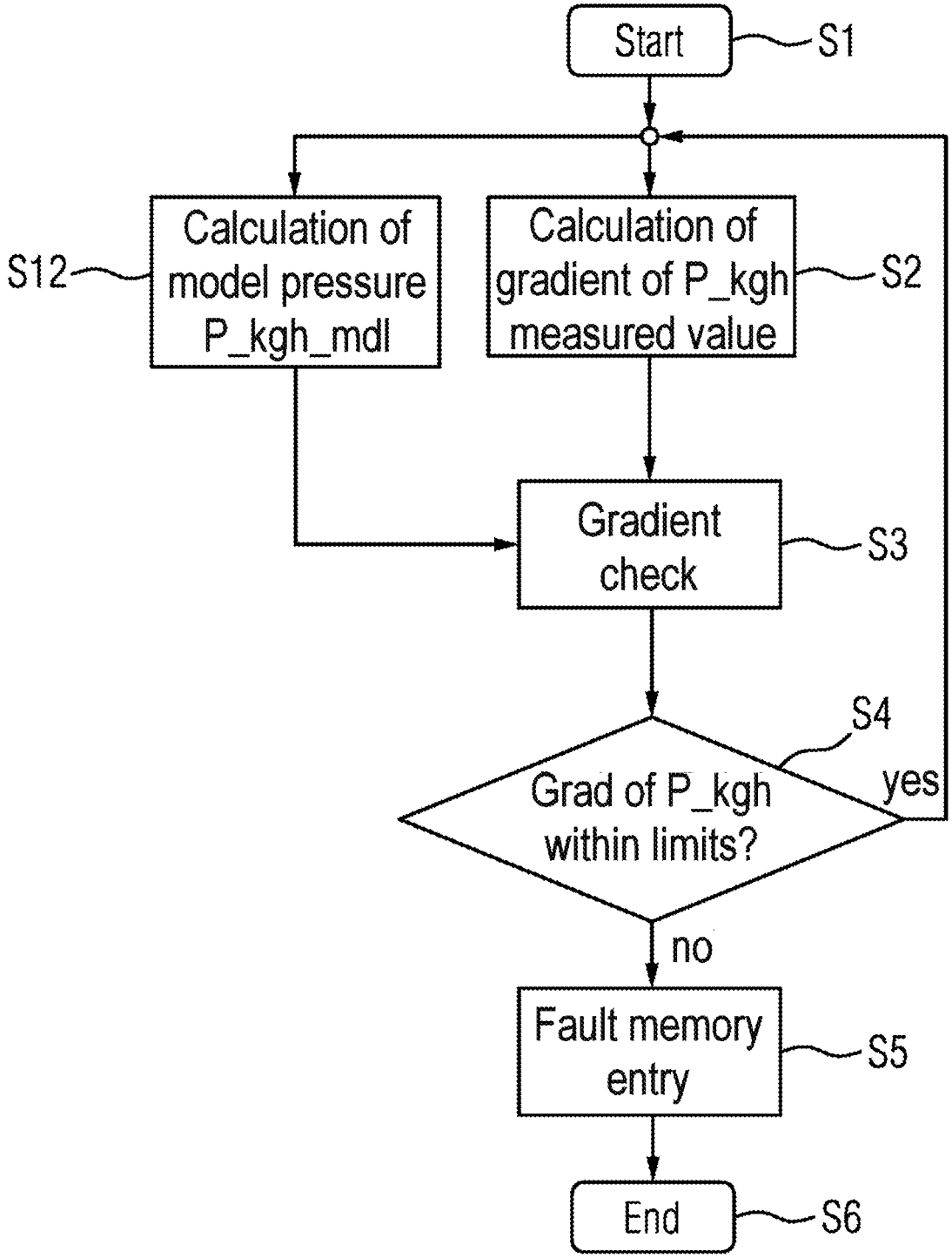
FIG. 11 shows a flow diagram for explaining a second exemplary method for checking the functionality of a crankcase ventilation system of an internal combustion engine.

FIG. 11 shows a flow diagram for explaining a method for checking the functionality of a crankcase ventilation system of an internal combustion engine according to a second exemplary example for the disclosure.

In this second exemplary example, the method likewise begins with a step S1. This is followed, in a step S2, by a measurement of the crankcase pressure P_kgh by the crankcase pressure sensor 26, a transmission of the measured pressure value to the control unit 10, and a calculation of the gradient of the crankcase pressure by the control unit 10. In a subsequent step S3, a gradient check is performed in the control unit 10.

For the purposes of this gradient check, by contrast to the method shown in FIG. 10, an ascertainment of a model pressure P_kgh_mdl is performed in a step S12. This ascertained model pressure is used in step S3 for the gradient check. For the purposes of the gradient check, a gradient with respect to time is also formed from this model pressure. By way of a now continuous comparison of the modeled and measured pressure, the method may be performed taking into consideration any tolerances.

In a subsequent step S4, it is queried whether the ascertained gradients of the sensor and model have similar profiles. If the ascertained gradient of the measured value accordingly lies within a range around the model gradient, then a return to step S2 is performed. If the ascertained gradient does not lie within the ascertained range, then a transition is made to step S5. In this step S5, an entry is recorded in a fault memory. Subsequently, a transition is made to a step S6, with which the method is ended. Aside from the continuous performance of this gradient comparison, the method may be performed in accordance with the approach above, that is to say only upon certain changes in operating point. Here, the gradient of the model pressure is used as a reference value in steps S9 and S11 in FIG. 10.

Overall, the diagnostic concept described above is based on the use of a pressure sensor which is positioned such that it can measure the pressure within the crankcase. To identify a leak in the crankcase ventilation system, an evaluation of the gradient with respect to time of the measured crankcase pressure is performed during various changes in the engine operating point. An implementation of this diagnostic concept is substantially independent of the engine configuration and the ventilation concept, because, instead of absolute pressure values, an evaluation of the pressure gradient is performed in order to identify leaks in the crankcase ventilation system. Furthermore, the entire crankcase ventilation system may be diagnosed through the use of a single, suitably positioned pressure sensor.

An evaluation of the gradient of the crankcase pressure during different dynamic changes in the operating point, for example in the case of negative load changes, positive load changes, starting of the engine or stopping of the engine, furthermore allows reliable identification of the possible fault locations/states of the crankcase ventilation system. For example, it is possible to diagnose which of the crankcase ventilation lines has a defect and whether an oil cap is missing. Active control of other engine components in order to bring about a certain operating state is also eliminated with this method.

An additional advantage that results from the use of a crankcase pressure sensor consists in the possibility of using the measured pressure value within a physical model for the crankcase ventilation arrangement. The mass flow that flows from the crankcase into the air path or the intake pipe can thus be modeled much more precisely. This is beneficial for a preliminary determination of the cylinder gas composition, which ultimately has a positive influence on the emissions of the engine, for example during highly transient engine operation.

Overall, in the above-described diagnosis of a crankcase ventilation system, the crankcase pressure is measured by a crankcase sensor. An ascertainment of the gradient with respect to time of the measured crankcase pressure is subsequently performed. Furthermore, an identification of a change in the operating point is performed. Suitable variables for the ascertainment and identification of a change in the operating point are, for example, the air path pressure and its gradient, the engine rotational speed, the ambient pressure and the throttle flap position. Depending on the identified change in the operating point, limit values for the crankcase pressure gradient are subsequently determined and used for a gradient check. A faulty system can be diagnosed by a comparison of the limit values with the ascertained gradient of the measured crankcase pressure after the identification of a change in the operating point. Based on the evaluation during individual changes in the operating point, which can be easily distinguished from one another, authoritative information regarding a respectively identified fault can be stored in the fault memory of the engine control unit of the respective vehicle, which allows fast and targeted exchange of defective components in a workshop.

A number of implementations have been described. Nevertheless, it will be understood that various modifications may be made without departing from the spirit and scope of the disclosure. Accordingly, other implementations are within the scope of the following claims.

LIST OF REFERENCE SIGNS

1 Internal combustion engine
2 Crankcase ventilation system
3 Crankcase
4 Crankcase outlet
5 Introduction point
6 Air path
7 Crankcase ventilation line
8 Suction jet pump
9 Ambient pressure sensor
10 Control unit
11 Memory
12 Safety valve
13 Oil separator
14 Pressure control valve
15 Fresh-air inlet
16 Air filter
17 Compressor
18 Charge-air cooler
19 Throttle flap
20 Crankcase ventilation line
21 Fresh-air line

22 Check valve
23 Memory
24 Turbine
25 Motive jet line
26 Crankcase pressure sensor
27 Oil cap
28 Intake pipe pressure sensor
29 Intake pipe pressure sensor
30 Introduction point

What is claimed is:

1. A method for checking functionality of a crankcase ventilation system of an internal combustion engine, the method comprising:

measuring a crankcase pressure in a crankcase of the internal combustion engine by a crankcase pressure sensor positioned in the crankcase, the crankcase having an outlet in fluid communication with two crankcase ventilation lines and a pressure control valve in fluid communication with the two crankcase ventilation lines of the crankcase ventilation system, the two crankcase ventilation lines and the pressure control valve are arranged between a crankcase outlet and an associated introduction point into an air path of the internal combustion engine, via which crankcase ventilation lines gas may be introduced from the crankcase into the air path, supplying the measured pressure values to a control unit, detecting a change in an operating point of the internal combustion engine, wherein the change of the operating point includes a negative load change or a positive load change, calculating a gradient with respect to time of the measured crankcase pressure based on the change in the operating point, performing a gradient check of the calculated gradient, checking whether the gradient satisfies a specified criterion to determine whether a leak is present in the two crankcase ventilation lines, wherein the specified criterion depends on whether a positive or a negative load change was detected, returning to the measurement of the crankcase pressure when the gradient satisfies the specified criterion, recording an entry in a fault memory when the gradient does not satisfy the specified criterion, and if the presence of a leak is determined, determining which of the two crankcase ventilation lines is defective by evaluating the gradient during the detected positive or negative load change.

2. The method as claimed in claim 1, wherein the change in the operating point includes a starting or stopping of the internal combustion engine.

3. The method as claimed in claim 2, further comprising:

ascertaining and using admissible limit values for the gradient when the change in the operating point is the starting or stopping of the internal combustion engine.

4. The method as claimed in claim 2, further comprising:

ascertaining and using a threshold value for the gradient when the change in the operating point change is the negative or positive load change.

5. A device for checking functionality of a crankcase ventilation system of an internal combustion engine, the crankcase ventilation system comprising:

a crankcase having a crankcase outlet, two crankcase ventilation lines arranged between the crankcase outlet and an associated introduction point into an air path of the internal combustion engine, the crankcase outlet in fluid communication with the two crankcase ventilation lines of the crankcase ventilation system, the two crankcase ventilation lines introduce gas from the crankcase into the air path, and a pressure control valve in fluid communication with the two crankcase ventilation lines in a location downstream from the crankcase outlet and upstream from each associated introduction point, a control unit configured to:

measure a pressure in the crankcase by a crankcase pressure sensor positioned in the crankcase, supply the measured pressure values to a control unit, detect a change in an operating point of the internal combustion engine, wherein the change of the operating point includes a negative load change or a positive load change, calculate a gradient with respect to time of the measured crankcase pressure, perform a gradient check of the calculated gradient, check whether the gradient satisfies a specified criterion to determine whether a leak is present in the two crankcase ventilation lines, wherein the specified criterion depends on whether a positive or a negative load change was detected, return to the measurement of the crankcase pressure when the gradient satisfies the specified criterion, recording an entry in a fault memory when the gradient does not satisfy the specified criterion, and if the presence of a leak is determined, determining which of the two crankcase ventilation lines is defective by evaluating the gradient during the detected positive or negative load change.

6. The device as claimed in claim 5, wherein the change of the operating point includes a starting or stopping of the internal combustion engine.

7. The device as claimed in claim 6, wherein the control unit is further configured to:

ascertain and use admissible limit values for the gradient when the change in the operating point is the starting or stopping of the internal combustion engine.

8. The device as claimed in claim 6, wherein the control unit is further configured to:

ascertain and use a threshold value for the gradient when the change in operating point is the negative or positive load change.

* * * * *